US008975546B2

(12) United States Patent
Kim et al.

(10) Patent No.: US 8,975,546 B2
(45) Date of Patent: Mar. 10, 2015

(54) CIRCUIT BREAKER PROVIDED WITH MECHANICAL TRIP MECHANISM

(71) Applicant: LSIS Co., Ltd., Anyang-si, Gyeonggi-do (KR)

(72) Inventors: Jong Doo Kim, Cheongju (KR); Hong Ik Yang, Cheongju (KR); Kil Young Ahn, Daejeon (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 71 days.

(21) Appl. No.: 13/727,328

(22) Filed: Dec. 26, 2012

(65) Prior Publication Data

US 2013/0168213 A1 Jul. 4, 2013

(30) Foreign Application Priority Data

Dec. 30, 2011 (KR) ..... 10-2011-0147818

(51) Int. Cl.

*H01H 1/52* (2006.01)
*H01H 3/04* (2006.01)
*H01H 3/30* (2006.01)
(Continued)

(52) U.S. Cl.

CPC ..... *H01H 3/04* (2013.01); *H01H 3/3015* (2013.01); *H01H 71/58* (2013.01); *H01H 3/12* (2013.01); *H01H 71/505* (2013.01); *H01H 2003/3089* (2013.01)
USPC ..... 200/322

(58) Field of Classification Search

USPC ..... 200/322, 400; 335/188
IPC ..... H01H 71/50,71/58
See application file for complete search history.

(56) References Cited

U.S. PATENT DOCUMENTS 5,973,278 A 10/1999 Wehrli, III et al.
7,038,155 B2 * 5/2006 Ahlert et al. ..... 200/400
(Continued)

FOREIGN PATENT DOCUMENTS

CN 101345165 1/2009
CN 101599396 12/2009
(Continued)

OTHER PUBLICATIONS

European Patent Office Application Serial No. 12199560.9, Search Report dated Feb. 20, 2014, 5 pages.
(Continued)

*Primary Examiner* — Vanessa Girardi
(74) *Attorney, Agent, or Firm* — Lee, Hong, Degerman, Kang & Waimey

(57) ABSTRACT

A circuit breaker having a mechanical trip mechanism enabling a circuit breaker to perform an emergency manual trip operation is provided. The circuit breaker includes: a fixed contactor connected to a circuit; a movable contactor movable to a closed state in which the movable contactor is in contact with the fixed contactor and a broken state in which the movable contactor is separated from the fixed contactor, an opening and closing mechanism configured to convert a rotational motion of a plurality of links and a rotational shaft to enable the movable contactor to be brought into contact with the fixed contactor or separated therefrom; a trip latch locked to or unlocked from a main link provided in the opening and closing mechanism; and an OFF button configured to rotate the trip latch to unlock the trip latch from the main link when manually pressed.

4 Claims, 12 Drawing Sheets

(51) Int. Cl.

| | |
|---|---|
| ***H01H 71/58*** | (2006.01) |
| ***H01H 3/12*** | (2006.01) |
| *H01H 71/50* | (2006.01) |

(56) References Cited

U.S. PATENT DOCUMENTS

| | | | | |
|---|---|---|---|---|
| 7,956,307 | B2 * | 6/2011 | Ahn | 218/154 |
| 2011/0011714 | A1 | 1/2011 | Gao | |

FOREIGN PATENT DOCUMENTS

| | | |
|---|---|---|
| EP | 2015336 | 1/2009 |
| JP | 60-257014 | 12/1985 |
| JP | 08-069734 | 3/1996 |
| JP | 11-040015 | 2/1999 |

OTHER PUBLICATIONS

Japan Patent Office Application Serial No. 2012-288083, Office Action dated Jan. 7, 2014 3 pages.

European Patent Office Application Serial No. 12199560.9, Search Report dated Mar. 27, 2013, 6 pages.

The State Intellectual Property Office of the People's Republic of China Application Serial No. 201210598992.3, Office Action dated Sep. 3, 2014, 7 pages.

* cited by examiner

CIRCUIT BREAKER PROVIDED WITH MECHANICAL TRIP MECHANISM

CROSS-REFERENCE TO RELATED APPLICATIONS

The present application claims priority under 35 U.S.C. §119(a) to Korean Patent Application No. 10-2011-0147818, filed on Dec. 30, 2011, the contents of which are hereby incorporated by reference herein in their entirety.

BACKGROUND

1. Field of the Invention

The present invention relates to a circuit breaker and, more particularly, to a circuit breaker having a mechanical trip mechanism enabling a circuit breaker to perform an emergency manual trip operation.

2. Description of the Related Art

In general, a circuit breaker is a device for selectively turning on or off or breaking a line between a power side and a load side in the occurrence of an overload, a short-circuit fault, an electric leakage, or an electric shock.

FIGS. 1, 2, and 3 illustrate a broken (trip) state (or an open state), a charged state, a closed (conducted) state of the related art circuit breaker.

In the related art circuit breaker, a user may press an OFF button 6 to manually perform a breaking operation, or when a fault current is detected, a circuit is automatically broken (a trip operation) to change the circuit breaker into a broken state.

In the case of the manual breaking operation, as illustrated in FIG. 3, when the user presses the OFF button 6 in a closed state, an OFF plate (not shown) is horizontally moved to the left in FIG. 3 to rotate an OFF shaft 4 in a clockwise direction to start a breaking operation of the circuit breaker.

In case of an automatic trip for interrupting a fault current in a circuit, an overcurrent trip relay installed outside an opening and closing mechanism 10 detects a fault current and transmits a trip control signal to an actuator, and the OFF shaft 4 is rotated in a clockwise direction by the actuator to start a breaking operation.

No matter whether it is manual or automatic trip, when the OFF shaft 4 is rotated in the clockwise direction, a trip latch 7 is rotated in a clockwise direction so as to be released from a restrained state with respect to a main link 9 (or the trip latch 7 is rotated in a clockwise direction so as to be unlocked from the main link 9), and a breaking spring 2, which has been stretched in the closed state to charge elastic energy, discharges the elastic energy to pull a connection shaft 21 connected to one end portion of the breaking spring 2 to rotate it in a counterclockwise direction. Accordingly, the opening and closing shaft 20 is also rotated in the counterclockwise direction and the connection link is moved to the right in FIG. 3 to pull a movable contactor 30 to the right, and the movable contactor 30 is separated from the fixed contactor 40, thus completing a manual breaking operation or automatic trip operation to electrically break the circuit.

In relation to the trip operation, FIGS. 4 and 5 are detailed views illustrating an operational relationship among the OFF shaft 4, the trip latch 7, and the main link 7 within the opening and closing mechanism 10 of the related art circuit breaker. In case of a circuit breaker that normally operates, the user may press the OFF button 6 to manually break the circuit breaker, or in case of a trip operation of the circuit breaker by an automatic trip executed when a fault current occurs, the OFF shaft 4 disposed on an upper portion of the opening and closing mechanism 10 is rotated in the clockwise direction. In the closed state, the trip latch 7 receiving a contact load (applied by the main link 9) in a contact portion 97 of the main link 9 and a trip latch roller 73 is rotated in the clockwise direction so as to be released (or unlocked) from the main link 9, and the contact load maintained in the contact portion of the main link 9 and the trip latch roller 73 in the closed state is changed into an open load, and as the open load is applied to the trip latch roller 73, a trip operation is substantially performed.

However, although the user presses the OFF button 6 so the OFF shaft 4 is rotated, if the trip latch 7 is not rotated in the clockwise direction and is not released from the main link 9, a trip operation of the circuit breaker is not actually performed, so a fault current cannot be interrupted.

Similarly, in the occurrence of an abnormal current, although the OFF shaft 4 is operated according to an automatic trip operation, if the trip latch 7 is not rotated in the clockwise direction due to several abnormal factors, the trip latch 7 is not released from the main link 9, resulting in failure of interrupting the fault current.

Thus, a circuit breaker that may reliably be changed into a broken state to cut off an electrical connection in the occurrence of an abnormal state in which the circuit breaker is not tripped in a manual manner or an auto-trip manner is required.

SUMMARY OF THE INVENTION

An aspect of the present invention provides a circuit breaker having a mechanical trip mechanism for allowing for an emergency manual trip operation in an abnormal state in which the circuit breaker is not tripped in a manual manner or auto-trip manner.

According to an aspect of the present invention, there is provided a circuit breaker including: a fixed contactor connected to a circuit; a movable contactor movable to a closed state in which the movable contactor is in contact with the fixed contactor and a broken state in which the movable contactor is separated from the fixed contactor, an opening and closing mechanism configured to convert a rotational motion of a plurality of links and a rotational shaft to enable the movable contactor to be brought into contact with the fixed contactor or separated therefrom; a trip latch locked to or unlocked from a main link provided in the opening and closing mechanism; and an OFF button configured to rotate the trip latch to unlock the trip latch from the main link when manually pressed.

According to an embodiment of the present invention, when an auto-trip operation is not possibly performed in an abnormal state, mechanical trip mechanism performs an emergency manual trip operation to reliably change the circuit breaker into a broken state. Also, a condition in which the circuit breaker is not changed into a broken state by a manual operation is basically prevented, thus obtaining stability and reliability.

The foregoing and other objects, features, aspects and advantages of the present invention will become more apparent from the following detailed description of the present invention when taken in conjunction with the accompanying drawings.

DETAILED DESCRIPTION OF THE INVENTION

Figure 1:
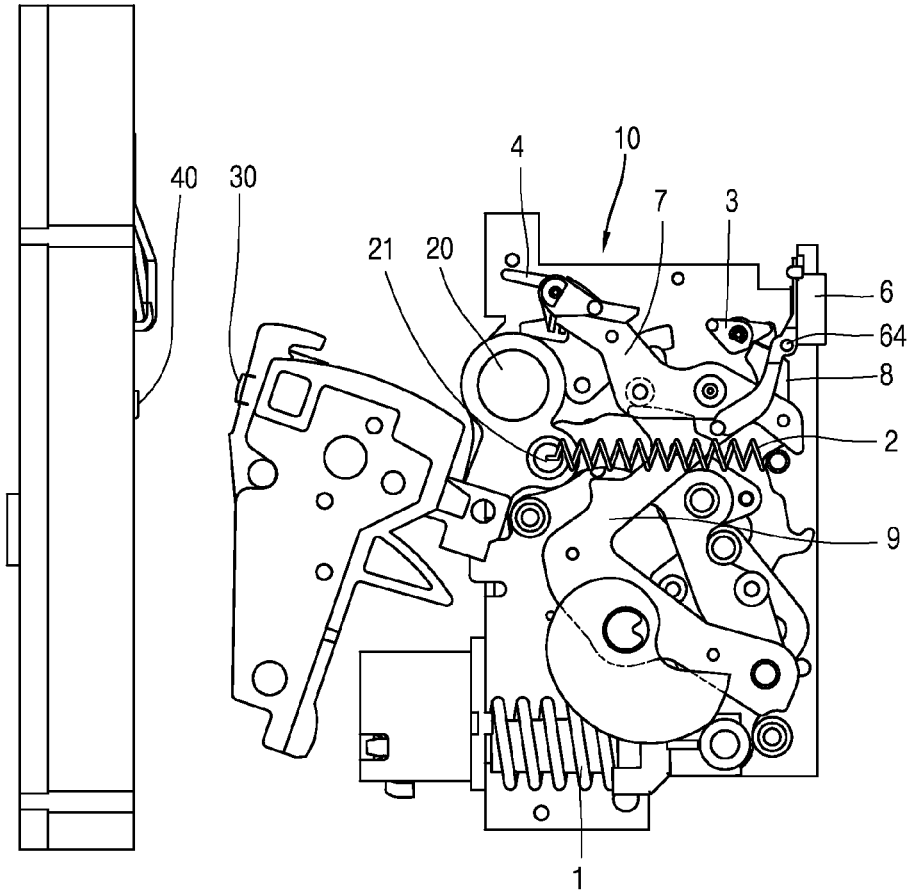
FIGURE 1 PRIOR ART
FIG. 1 is a side view illustrating a broken state of the related art circuit breaker.
Figure 2:
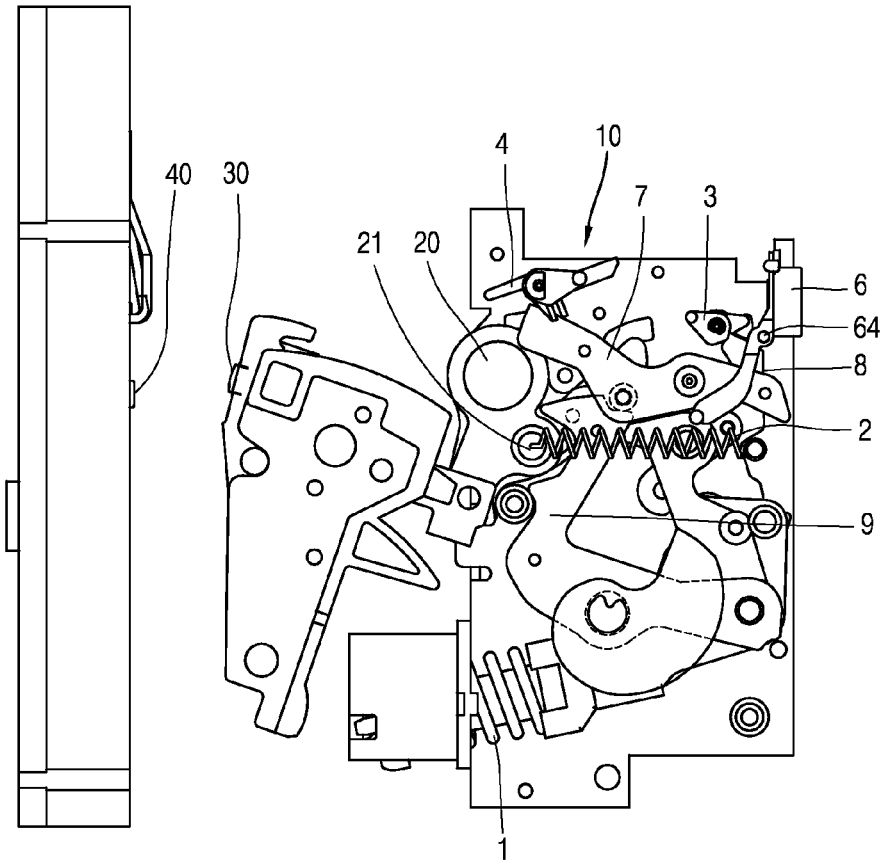
FIGURE 2 PRIOR ART
FIG. 2 is a side view illustrating a charged state of the related art circuit breaker.
Figure 3:
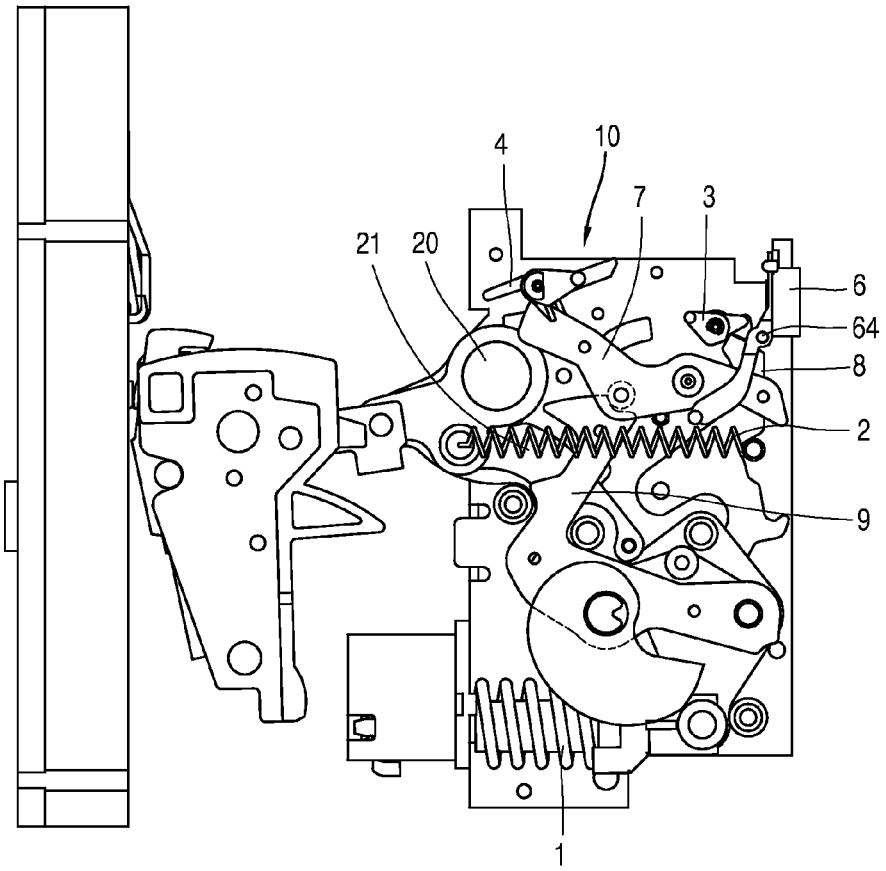
FIGURE 3 PRIOR ART
FIG. 3 is a side view illustrating a closed state of the related art circuit breaker.
Figure 4:
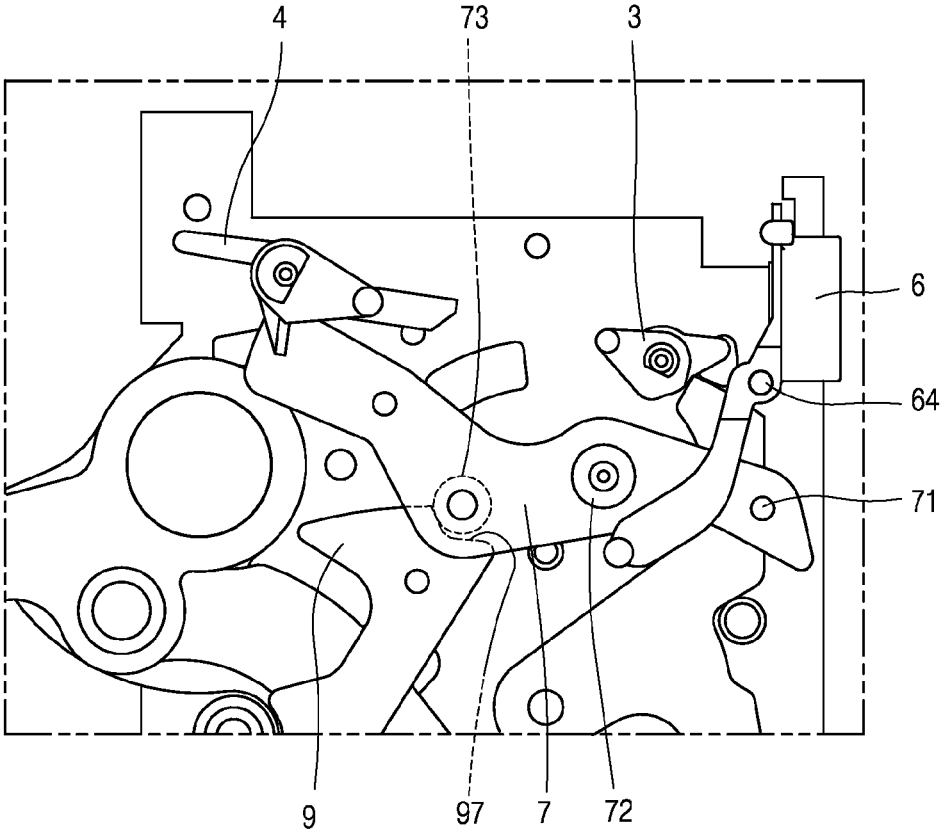
FIGURE 4 PRIOR ART
FIG. 4 is a detailed view of a trip operation by an OFF shaft and a trip latch in the related art circuit breaker.
Figure 5:
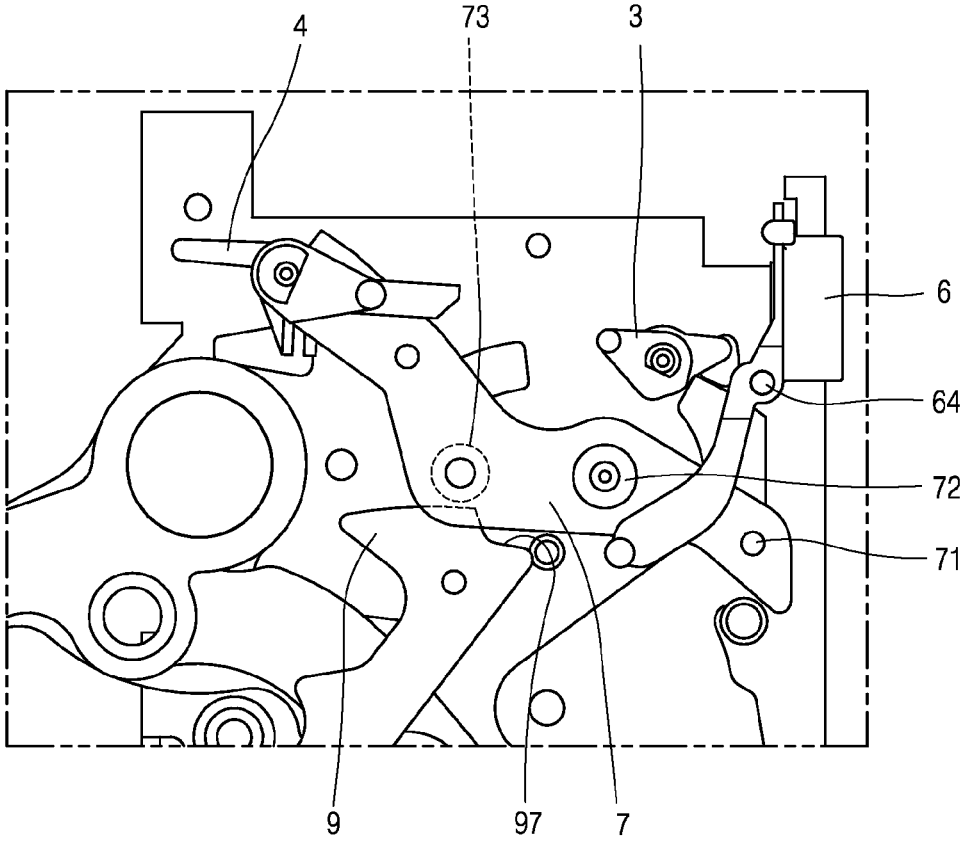
FIGURE 5 PRIOR ART
FIG. 5 is a detailed view of a trip operation by a trip latch and a main link in the related art circuit breaker.

Hereinafter, a mechanical trip mechanism of a circuit breaker according to an embodiment of the present invention will be described in detail with reference to the accompanying drawings.

The circuit breaker includes an opening and closing mechanism 10 converting a rotational motion of a plurality of links and a rotational shaft to compress a closing spring 1 and generating driving force according to elastic restoring force of the closing spring 1, an opening and closing shaft 20 connected to an opening and closing mechanism and transmitting driving force generated by the opening and closing mechanism, a fixed contactor 40, a movable contactor 30 movable to a closed state in which the movable contactor 30 is in contact with the fixed contactor 40 and a broken state in which the movable contactor 30 is separated from the fixed contactor, an overcurrent trip relay (not shown) outputting a control signal to trip the opening and closing mechanism 10 when an abnormal current is generated, and an actuator (not shown) for tripping the opening and closing mechanism by a control signal from the overcurrent trip relay. The configuration of the circuit breaker is the same as that of the related art circuit breaker, so a detailed configuration and operation thereof will be omitted.

Figure 6:
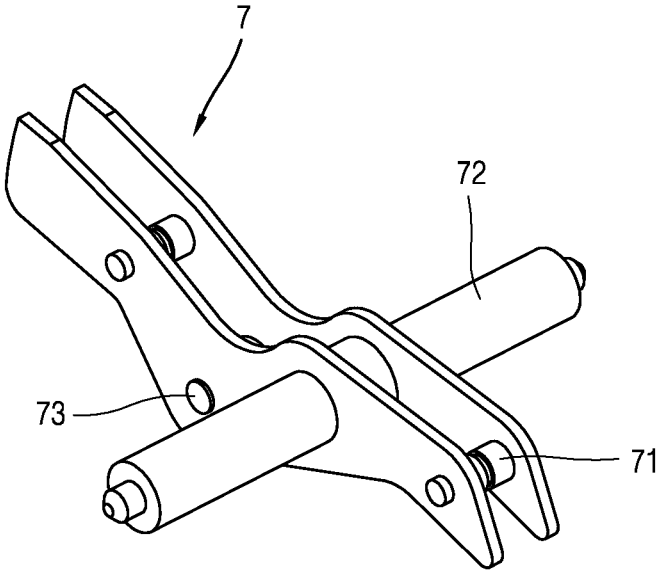
FIGURE 6 PRIOR ART
FIG. 6 is a perspective view of a trip latch assembly installed in an opening and closing mechanism of the related art circuit breaker.
Figure 7:
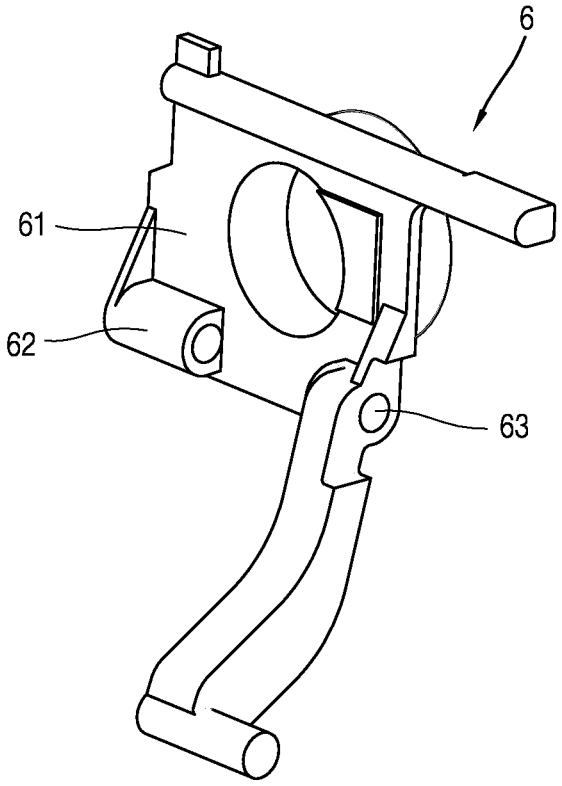
FIGURE 7 PRIOR ART
FIG. 7 is a perspective view of an OFF button installed in the opening and closing mechanism of the related art circuit breaker.

FIGS. 6 and 7 are perspective views of an OFF button and a trip latch provided in the related art circuit breaker. As illustrated in FIG. 6, in an assembly of a trip latch 7, two trip latches placed to be parallel in a length direction are coupled by a connection pin 71.

A rotational shaft 72 of the trip latch is installed to penetrate the assembly of the trip latch 7, and a trip latch roller 73 is provided between the rotational shaft 72 and one connection pin 71. As can be seen in *fig.* 7, a reinforcing unit 62 is provided in a body frame 61 of an OFF button 6 on a rear surface of the OFF button 6. The OFF button is supported to be rotatable at a predetermined angle by a button support 64 installed to penetrate an opening 63 formed in the reinforcing unit 62.

In a closed state of the circuit breaker, the main link 9 and the trip latch 7 are locked, a contact load is applied to a contact portion 97 of the main link 9 and the trip latch roller 73, and a locked state of the main link 9 and the trip latch roller 73 is maintained. When the circuit breaker is changed from a closed state to a broken state, the trip latch roller 73 is released from a state of being locked to the main link 9, a contact load is changed into an open load, and the open load is applied to the trip latch roller 73 by the main link 9.

When the circuit breaker normally operates, the OFF shaft 4 in an upper portion of the opening and closing mechanism 10 is rotated in a clockwise direction according to a manual and auto-trip operation, and accordingly, the trip latch 7 is rotated in a clockwise direction based on the rotational shaft 72 of the trip latch 7, and thus, the trip latch roller 73 locked in the main link 9 is released. Thus, in order for the circuit breaker to be actually changed from the closed state to the broken state, the trip latch 7 should be rotated in the clockwise direction based on the rotational shaft 72 of the trip latch 7 to release the trip latch roller 73 locked in the main link 9.

Hereinafter, the mechanical trip mechanism of the circuit breaker according to an embodiment of the present invention will be described in detail.

First, a configuration of the mechanical trip mechanism of the circuit breaker according to an embodiment of the present invention will be described.

Figure 8:
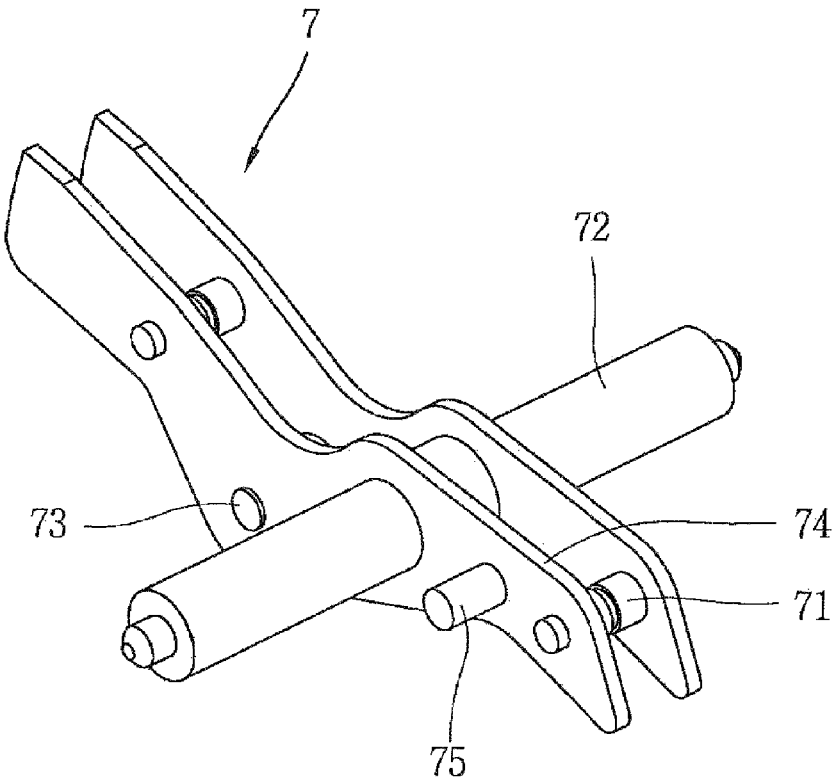
FIG. 8 is a perspective view of an OFF button of a circuit breaker according to a first embodiment of the present invention.
Figure 9:
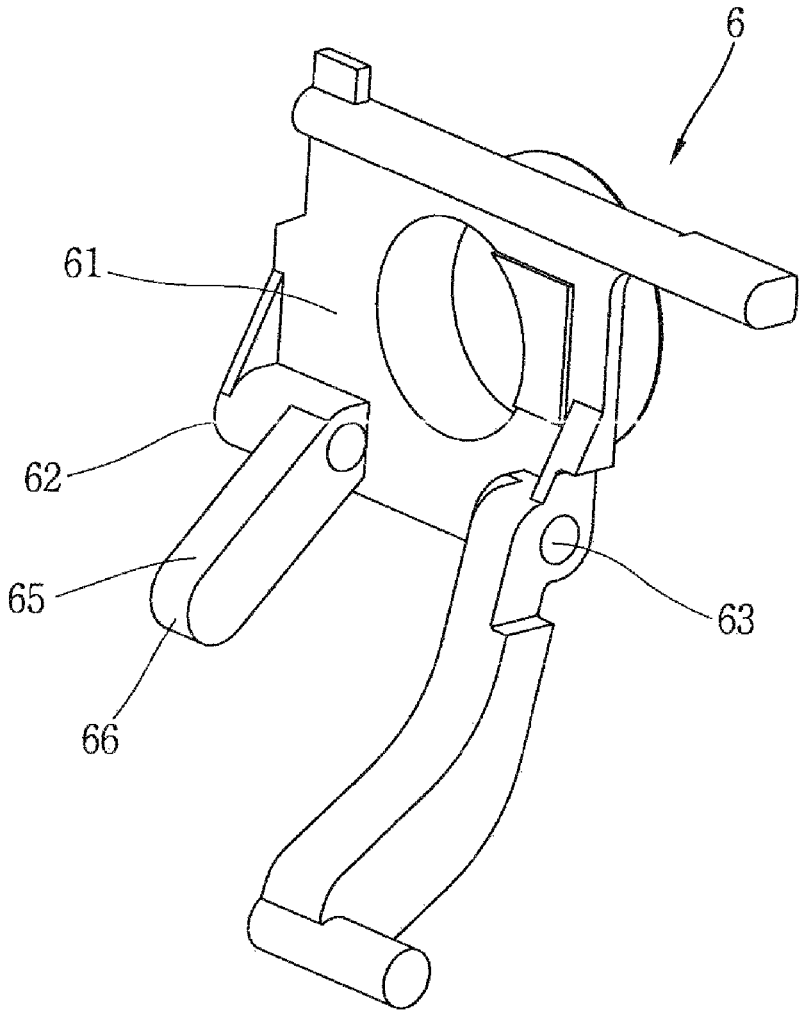
FIG. 9 is a perspective view of a trip latch assembly of the circuit breaker according to the first embodiment of the present invention.

In FIGS. 8 and 9, the OFF button 6 and the trip latch 7 according to a first embodiment of the present invention including the mechanical trip mechanism are illustrated. The mechanical trip mechanism includes a lever member 65 formed in the OFF button 6 and a protrusion member 75 coupled to the trip latch 7. The lever member 65 and the protrusion member 75 are in a relationship of an operating unit and an operated unit that directly rotate the trip latch 7 in the clockwise direction when a user presses the OFF button 6 in order to change the circuit breaker into a broken state.

As illustrated in FIG. 9, the lever member 65 provided on a rear surface of the OFF button 6 is provided in the reinforcing unit 62 of the OFF button having an opening 63 through which a button support pin 64 is inserted. Preferably, the lever member 65 is integrally formed with the OFF button 6. The lever member 65 integrally formed in a body frame 61 of the OFF button 6 is protruded to have a certain length such that it is parallel to a length direction of the trip latch 7. The lever member 65 has a rectangular parallelepiped shape overall, and a front end portion 66 of the lever member 65 has a curved surface. In general, an ON button (not shown) and the OFF button 6 installed on a front portion of the circuit breaker and manually operated by the user are installed to be supported by a button support pin 64 penetrating the opening 63 of the OFF button 6. Thus, when the user presses the button, the OFF button is rotatable within a predetermined angle range based on the button support pin 64.

As illustrated in FIG. 8, the protrusion member 75 of the trip latch 7 is provided on one surface of the trip latch 7. The protrusion member 75 of the trip lath 7 is protruded to have a predetermined length toward the lever member 65 of the OFF button 6 along an axial line direction of the rotational shaft 72 of the trip latch 7. As for the length of the protrusion member 75, the protrusion member 75 is protruded to slightly exceed the lever member 65 of the OFF button in a state of being installed in the opening and closing mechanism. Thus, when the OFF button is rotated based on the button support pin 64 as the user presses the OFF button 6, the front end portion 66 of the lever member 65 rotated together according to the rotation of the OFF button reliably pressurizes the side of the protrusion member 75.

The protrusion member 75 may be integrally formed with the trip latch 7 or may be separately formed and coupled to the trip latch 7. When the protrusion member 75 is separately formed, the protrusion member 75 may be coupled to the trip latch 7 according to a certain method known in the art. For example, the protrusion member 75 may be coupled to the trip latch 7 according to a coupling method such as welding, caulking coupling, bolt fastening, or the like.

Figure 10:
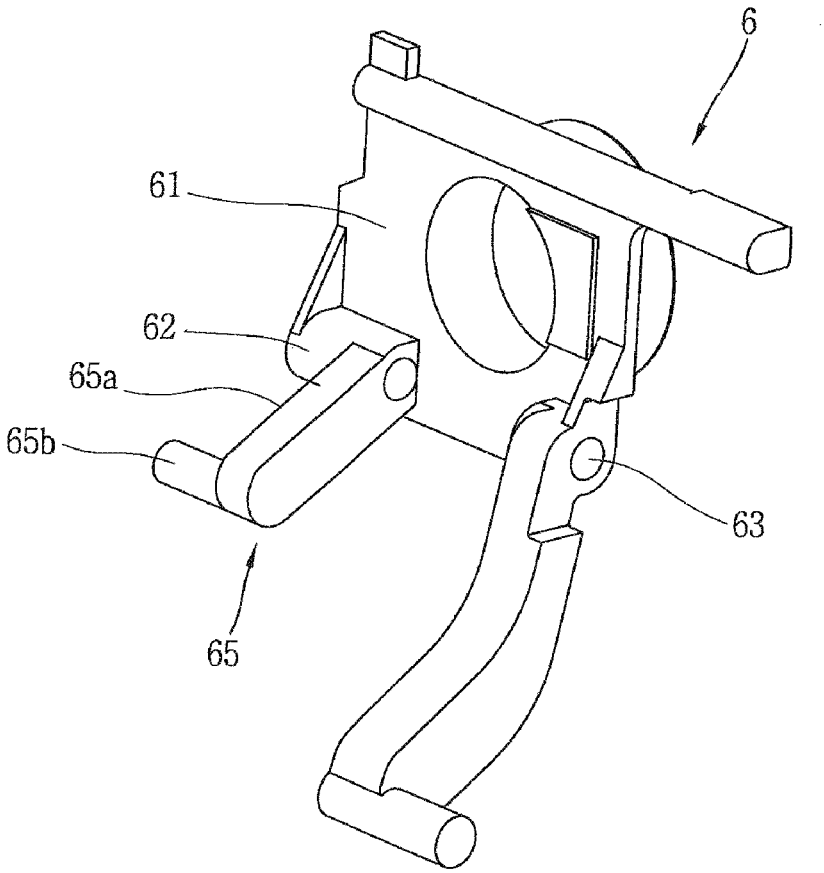
FIG. 10 is a perspective view of an OFF button of a circuit breaker according to a second embodiment of the present invention.

Referring to FIG. 10, an OFF button 6 according to a second embodiment of the present invention including a mechanical trip mechanism is illustrated. In the second embodiment, the lever member 65 is formed on the body frame 61 of a rear surface of the OFF button 6. Unlike the first embodiment as described above, the lever member 65 according to the second embodiment includes a first lever unit 65*a* and a second lever unit 65*b*. The first lever unit 65*a* extends to be parallel to a length direction of the trip latch 7, and the second lever unit 65*b* is protruded from an end portion of the first lever unit 54*a* toward the trip latch 7 such that it is parallel to the rotational shaft of the trip latch 7. In order to allow the second lever unit 65*b* to rotate the trip latch 7 in a clockwise direction, the second lever unit 65*b* has a length sufficient to simultaneously press one edge portion 75 of the trip latch 7 or both edge portions of the trip latch 7 of the trip latch assembly. Also, in the second embodiment, preferably, the lever member 65 is integrally formed with the OFF button 6. However, the second lever unit 65*b* of the lever member 65 may be separately formed and coupled.

In the case of the second embodiment illustrated in FIG. 10, the lever member 65 provided in the OFF button 6 and having the first lever unit 65*a* and the second lever unit 65*b* has both the functions of the mechanical trip mechanism of the lever member 65 provided in the OFF button 6 and the protrusion member 75 provided in the trip latch 7. Namely, the second lever unit 65*b* of the lever member 65 according to the second embodiment of the present invention corresponds to the protrusion member in the first embodiment as described above. Thus, in the second embodiment, when the lever member 65 is rotated as the OFF button 6 is pressed, the second lever 65*b* of the lever member 65 directly presses the edge portion 74 of the trip latch 7 to rotate the trip latch 7 in a clockwise direction based on the rotational shaft 72 of the trip latch 7.

Hereinafter, an operation of the mechanical trip mechanism in the circuit breaker according to an embodiment of the present invention will be described.

Figure 11:
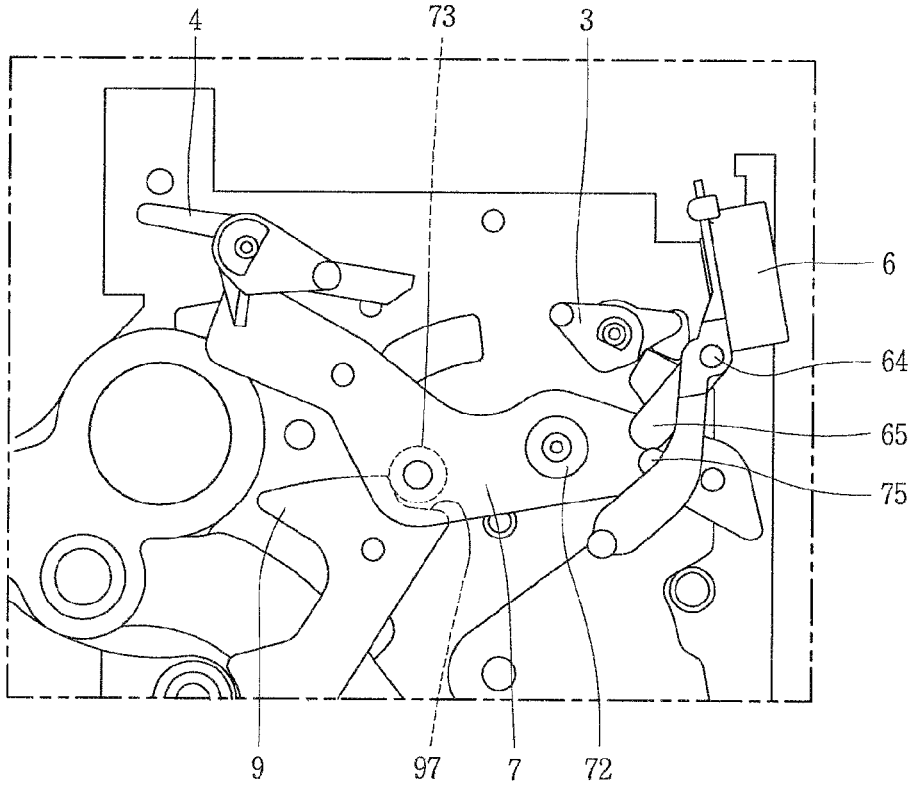
FIGS. 11 and 12 are detailed views of a trip operation by the OFF button and the trip latch assembly of the circuit breaker according to the first embodiment of the present invention.
Figure 12:
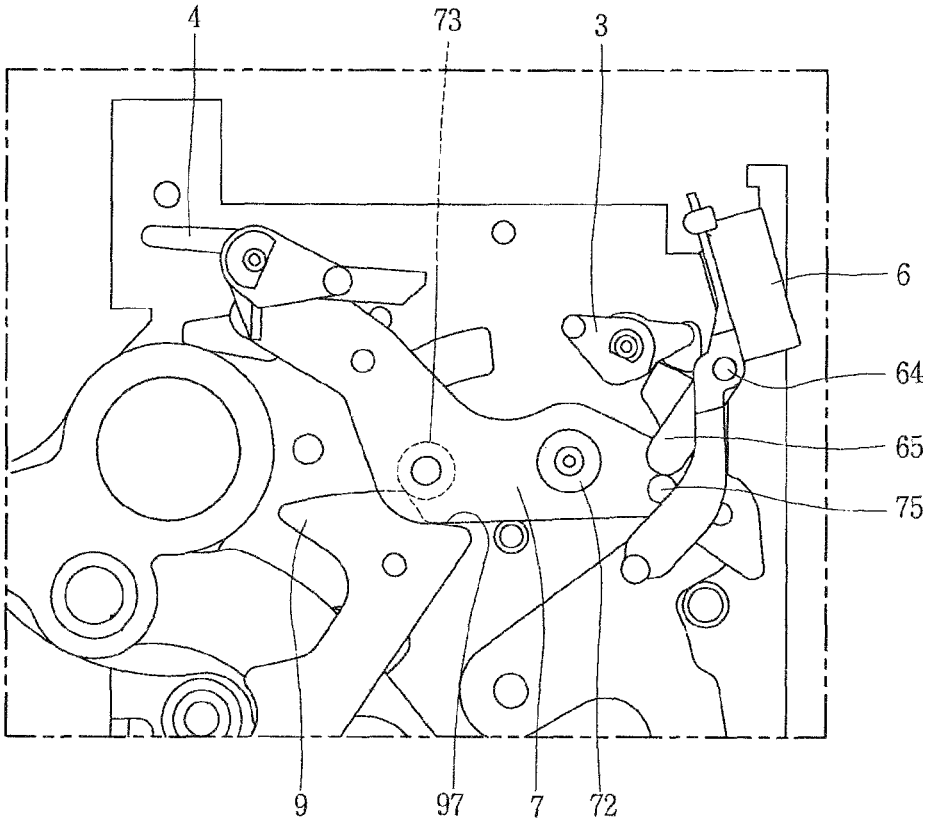

FIGS. 11 and 12 are detailed views illustrating a trip operation of the circuit breaker by the OFF button 6 and the trip latch 7 having the mechanical trip mechanism according to an embodiment of the present invention, and the mechanical trip mechanism corresponds to the first embodiment including the lever member 65 of the OFF button and the protrusion member 75 of the trip latch 7.

In the circuit breaker according to an embodiment of the present invention, when the user manually presses the OFF button 6 provided on a front portion of the circuit breaker, the OFF button rotates based on the button support pin 64. At the same time, the lever member 65 of the OFF button is rotated. Thus, as shown in FIG. 11, the front end portion 66 of the lever member is brought into a lateral surface of the protrusion member 75 provided in the trip latch 7 to pressurize the trip latch 7. Subsequently, in a continuous process, as shown in FIG. 12, the lever member 65 continuously pressurizes the protrusion member 75 of the trip latch 7, and thus, the trip latch 7 is rotated in a clockwise direction. Accordingly, the trip latch roller 73 locked in the main link 9 is released, and a contact load maintained in the contact portion 97 of the main link 9 and the trip latch roller 73 in the closed state of the circuit breaker is changed into an open load and transmitted to the trip latch roller 73. Accordingly, the trip operation of the circuit breaker is certainly, reliably executed.

Also, in the second embodiment, similarly, when the OFF button 6 is operated manually, the second lever unit 65*b* of the lever member 65 provided in the OFF button 6 directly pressurizes the edge portion 74 of the trip latch 7, and thus, the trip latch 7 is rotated in the clockwise direction. As the trip latch 7 is rotated in the clockwise direction, the trip latch roller 73 locked in the main link 9 is released, thus executing a trip operation of the circuit beaker.

As described above, in the circuit breaker according to an embodiment of the present invention, since the OFF button 6 includes the mechanical trip mechanism as an emergency manual trip means, the trip latch 7 can be directly rotated in the clockwise direction in association with an operation of the OFF button 6 to release the trip latch roller 73 locked in the main link 9. Thus, even when an auto-trip operation is not possibly performed in an abnormal situation, the circuit breaker can be change into a broken state through the emergency manual trip operation. In addition, a situation in which the circuit breaker is not changed into a broken state through a manual operation is fundamentally prevented.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A circuit breaker comprising:

a fixed contactor connected to a circuit;

a movable contactor movable to a closed state in which the movable contactor is in contact with the fixed contactor and a broken state in which the movable contactor is separated from the fixed contactor;

an opening and closing mechanism configured to convert a rotational motion of a plurality of links and a rotational shaft to enable the movable contactor to be brought into contact with the fixed contactor or separated from the fixed contactor;

a trip latch locked to or unlocked from a main link provided in the opening and closing mechanism; and an OFF button configured to rotate the trip latch to unlock the trip latch from the main link when manually pressed, wherein the OFF button includes a lever member configured to rotate the trip latch, and the lever member includes a first lever unit extending parallel to a length direction of the trip latch and a second lever unit extending parallel to a rotational axial line of the trip latch.

2. The circuit breaker of claim 1, wherein the trip latch includes a protrusion member pressed by the lever member.

3. The circuit breaker of claim 1, wherein the second lever unit of the lever member extends from an end portion of the first lever unit.

4. The circuit breaker of claim 3, wherein the second lever unit presses an edge portion of the trip latch to rotate the trip latch.

* * * * *